United States Patent [19]

LeBlond

[11] Patent Number: 4,615,160

[45] Date of Patent: Oct. 7, 1986

[54] ADJUSTABLE STAIRCASE

[76] Inventor: Marc LeBlond, 7268 des Martres, Orsainville (Quebec), Canada, G1G 1A7

[21] Appl. No.: 781,693

[22] Filed: Sep. 30, 1985

[51] Int. Cl.[4] ..... E02D 5/74

[52] U.S. Cl. ..... 52/183; 52/157; 182/1; 14/71.1

[58] Field of Search ..... 52/109, 183; 14/69.5, 14/71.1; 182/1, 97, 156, 157

[56] References Cited

U.S. PATENT DOCUMENTS

| | | | |
|---|---|---|---|
| 188,266 | 4/1877 | Stead . | |
| 356,523 | 2/1887 | Williamd . | |
| 1,186,404 | 8/1916 | Kalenits . | |
| 1,912,138 | 5/1933 | Hoover | 182/157 |
| 2,867,855 | 1/1959 | Xanten | 14/71.1 X |
| 2,981,362 | 11/1961 | Troche . | |
| 3,265,155 | 8/1966 | Thatcher, Jr. | 182/157 X |
| 3,626,438 | 12/1971 | Cornell | 52/183 |
| 3,962,838 | 6/1976 | Cox | 182/1 X |
| 4,527,941 | 7/1985 | Archer | 182/157 X |

FOREIGN PATENT DOCUMENTS

| | | | |
|---|---|---|---|
| 299714 | 4/1930 | Canada . | |
| 324658 | 8/1932 | Canada . | |
| 844261 | 6/1970 | Canada . | |
| 915380 | 11/1972 | Canada . | |
| 1044669 | 3/1978 | Canada . | |
| 1040383 | 9/1978 | Canada . | |
| 1151833 | 4/1983 | Canada . | |
| 16075 | of 1897 | United Kingdom | 14/71.1 |
| 179796 | 5/1922 | United Kingdom | 182/157 |

*Primary Examiner*—William F. Pate, III
*Assistant Examiner*—Creighton Smith
*Attorney, Agent, or Firm*—Robic, Robic & Associates

[57] ABSTRACT

Adjustable staircase having a pair of stringers each provided with a pair of pantographs, disposed one above the other, identical in overall length and having diagonal levers also of equal length, which levers are pivoted at their center and end points. The ends of the pantographs are mounted to connectors that are intended to be fixed to the two different levels that are to be joined. This mounting is such that the ends of the two pantographs, at each level, can pivot about axes that lie in horizontal planes so that if the levels to be connected are moved away or toward one another, corresponding pivot points on the two pantographs move together in parallel horizontal pivot points planes. The threads of the staircase are fixed to the pantographs by means of supports each of which has a tread portion which is secured to one edge of one tread and a pantograph portion which is pivotally connected to corresponding pivot points lying in the same horizontal plane. Each pantograph is enclosed in a casing having open ends through which the connectors extend as well as further openings for the tread connectors.

6 Claims, 6 Drawing Figures

ADJUSTABLE STAIRCASE

FIELD OF THE INVETION

The present invention relates to an adjustable staircase intended to be secured at an angle between two parts at different levels.

The staircase of the invention is of the type in which the angle of incline and/or the height between the ends may be varied to suit particular conditions.

OBJECTS OF THE INVENTION

A main object of the invention is to provide an adjustable staircase of the above type which can be readily adjusted to suit the various conditions aforesaid of incline and/or height in a particularly simple manner and with no special tools so that the staircase may be set into position by unskilled labor.

A further object is that the staircase of the invention can be prefabricated in a manufacture so as to be ready for fixing to the required levels, when arriving on site.

Still another object lies in that the constructional features of the staircase, according to the invention, are so simple that the latter can be made rapidly and at low cost.

As a preferred object, the invention also provides a staircase which is adjustable not only as to length, height and incline but as to width between the stringers, as well.

BROAD DESCRIPTION OF THE INVENTION

These objects are attained by the provision of a staircase having a pair of stringers, each stringer making use of a pair of pantographs, such as those found in lazy-tong devices, which are identical in overall length as well as in diagonal lever length; these diagonal levers, as is known, are pivoted at their central points and at their end points. These two pantographs of each stringer lie in the same vertical plane, one above the other, and their ends are mounted to connectors to be fixed each at one of the levels to be joined, one level being often the ground level. The mounting is such that the two ends of the pantography, at each level, can pivot about axes that lie in horizontal planes so that, if the level connectors are moved away or toward one another or laterally with respect to each other, corresponding pivot points on the two pantographs move together in parallel horizontal pivot points planes.

The treads of the staircase extend between the stringers and are fixed to the pantographs by means of supports. Each support has a tread portion which, as its name implies, is secured to the edge of one tread and a pantograph portion which is pivotally connected to corresponding pivot points of the pantographs that lie in the same horizontal planes.

For safety sake and aesthetic purpose, the pantographs are each enclosed in an open-ended casing, provision being made for the outlet of the tread supports for connection to the treads.

According to a preferred embodiment of the invention, each tread is formed of two coplanar side sections that are joined, at the center, by a slide device so that the treads may be widened or narrowed, by slidable movement of the coplanar side sections, when the stringers are moved away or toward one another.

THE PRIOR ART

A search was made prior to the filing of this application which has revealed the following patents:

Canadian Pat. Nos.

299,714—Apr. 29, 1930
324,658—Aug. 2, 1932
844,261—June 16, 1970
915,380—Nov. 28, 1972
1,040,383—Oct. 17, 1978
1,044,669—Dec. 19, 1978
1,151,833—Aug. 16, 1983

U.S. Pat. Nos.

188,266—Mar. 13, 1877
358,523—Mar. 1, 1887
1,186,404—June 6, 1916
2,981,362—Apr. 25, 1961

A mere cursory look at each of these patents indicates that no adjustable staircase is disclosed is of the above type involving two stringers each having two identical pantographs, one above the other in the same vertical plane, with the treads held in constant horizontal parallel planes by means of supports, each of which has a portion which is fixed to the end edge of a tread and the other portion to a pair of lever pivot points, on the two pantographs, lying in the same horizontal plane, as aforesaid.

A description of a preferred embodiment of the invention now follows having reference to the appended drawing wherein.

DESCRIPTION OF THE PREFERRED EMBODIMENT

Figure 1:
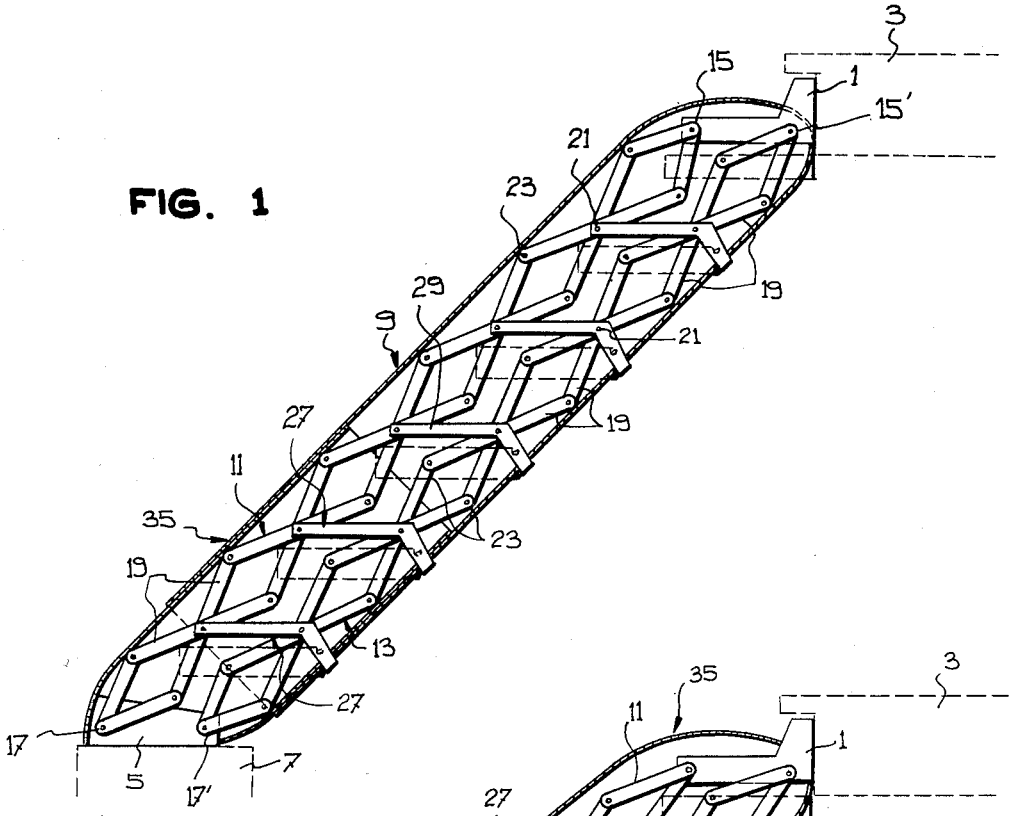
FIG. 1 is a side elevation view of a side stringer of a staircase made according to the invention, the sidewall of the stringer casing being removed to show the inner structure.

Referring to the drawing, the adjustable staircase includes an upper connector 1 to be secured, in any known manner, to a high level landing 3 and a second connector 5 to be secured to a low-level ending 7, usually a base sitting on the ground. A pair of stringer structures 9 extends between the connectors 1 and 5, being mounted at either ends thereof as best illustrated in FIG. 3.

Each of these stringer structures comprises two pantographs 11, 13 of equal length that extend lengthwise between the connectors 1 and 5, being disposed one above the other in the same plane of operation. Each pantograph 11 and 13 has opposed ends 15, 15' for the high level 3 and 17, 17' for the low level 7. Each pantograph 11, 13, is formed of a succession of diagonal levers 19 of equal length pivoted at centre points 21 and at end points 23. The opposed ends 15, 15', 17, 17', of the pantographs 11, 13, are mounted respectively on the connectors 1, 5, for pivotal movement about parallel axes that lie in an upper and a lower horizontal plane, as clearly shown in FIGS. 1 and 2. Thus, according to the pantograph principle, corresponding pivot points 21, 23, on the two pantographs 11, 13, move together in planes that are horizontal and parallel and contain the pivot points when the connectors 1 and 5 are moved with respect to one another. It will thus be appreciated that the incline, the height and/or the length of the stringers 9 can be adjusted to suit a large number of various relative positions between the levels 3 and 7.

Figure 3:
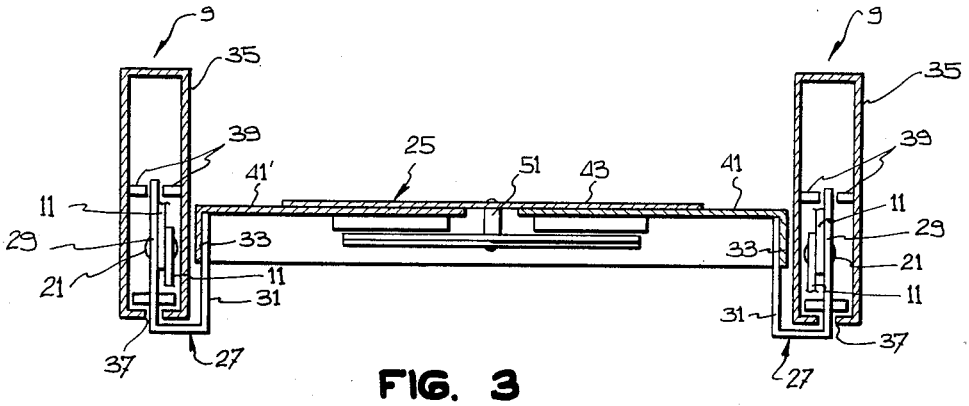
FIG. 3 is a cross-sectional view of the staircase of FIGS. 1 and 2.

As illustrated in FIG. 3, treads 25 extend between the stair stringers 9. Each such tread 25 is connected to the aforedescribed pantographs 11, 13, by a pair of tread supports 27, there being one such tread support at either end of each tread 25.

As perhaps best illustrated in FIG. 3, each tread support comprises a pantograph portion 29 pivotally connected to two corresponding pivot points, preferably centre points 21, lying in one of the aforesaid pivot points horizontal planes, that is one central point 21 of upper pantograph 11 and the adjoining central point 21 of the lower pantograph 13. Each tread support 29 additionally comprises a tread portion 31, best illustrated in FIG. 3, the end of which is fixed to the end edge 33 of the tread 25. The end edges 33 of the tread 25 may be downturned edges of the tread proper, again as shown in FIG. 3. In this manner, considering that corresponding centre points 21 of the pantograph 11, 13, constantly lie in horizontal planes, the supports 29 are able to hold the treads 25 in horizontal relationship but at varying distance therebetween consequent to the pantographs 11, 13, being lengthened or shortened.

Again, as best shown in FIG. 3, each tread support 27 is generally in the shape of a U with the two legs or portions 29, 31 being slightly offset, vertically.

It will be noted that the two legs or portions 29, 31, of the thread supports 27 lie on either side of the pantographs 11, 13.

Figure 2:
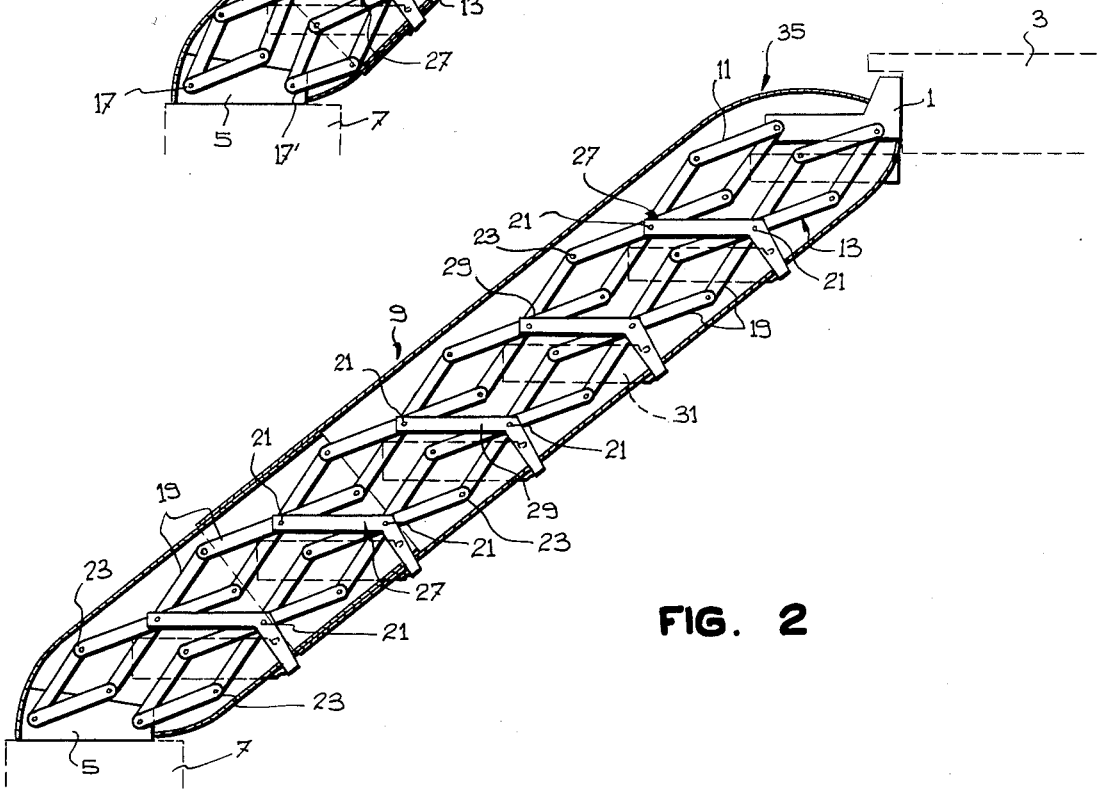
FIG. 2 is view like that of FIG. 1 but showing the stringer (and accordingly, staircase) at a different incline and length.

From FIGS. 1 and 2, it will be further noted that the opposed ends 15, 15', 17, 17', of each pantograph 11, 13, are formed of a pair of half-length levers connected at the free ends thereof.

For safety and aesthetical purposes, each stringer structure further comprises a casing 35 made up of two telescoping parts so as to permit length adjustment of the pantograph 11, 13. Each of the casing 35 is open at the ends to allow the connectors 1 and 5 to project out to be connected to the landings 3 and 7. Additionally, the bottom of each casing 35 is formed with proper apertures 37 for the passage of the U-shaped tread supports 27 (see FIG. 3).

Bumper members 39 may also be provided within the casings 35, bumpers being spaced from one another and serving as guides for the pantographs 11, 13.

Figure 4:
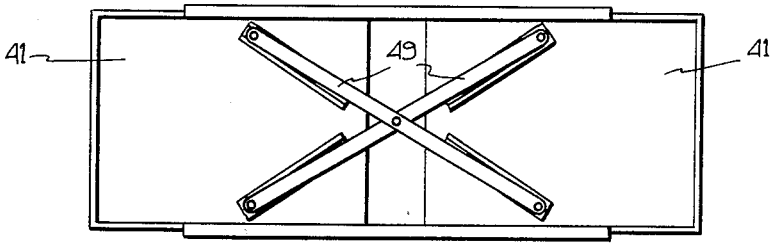
FIG. 4 is a bottom view of a width-adjustable tread.
Figure 5:
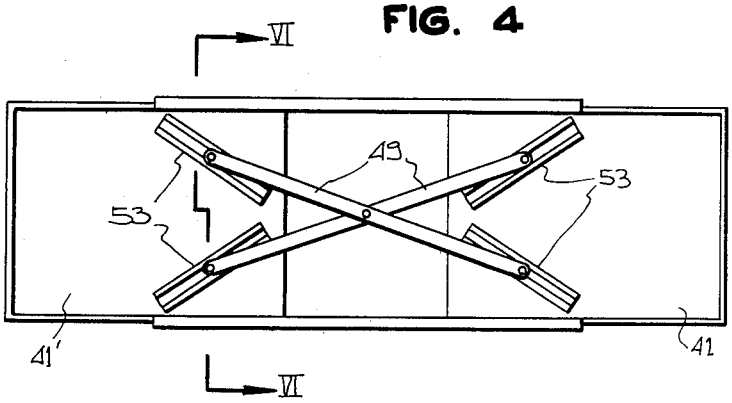
FIG. 5 is a view of the tread of FIG. 4 in outwardly extended condition.
Figure 6:
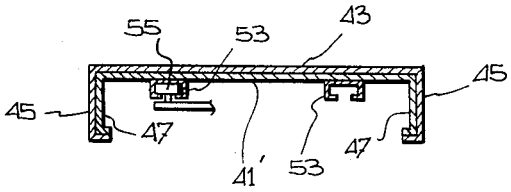
FIG. 6 is a cross-sectional view in a plane along line VI—VI of FIG. 5.

As mentioned previously, the treads 25 are preferably made to be extensible in width by a structure illustrated in FIGS. 4, 5 and 6. In this case, each tread comprises two coplanar side sections 41, 41' extending from the bent end edges 33 aforedescribed and centrally spaced from one another. Appropriate joining means hold side sections 41, 41' together for relative slidable displacement therebetween and lengthwise of the tread 25 when the stringer structures 9 are moved to and from one another. As shown, such joining means comprise, for each tread, a central flat horizontal tread section 43 overlapping the side sections 41, 41', and having downwardly turned lateral edges 45 which are further bent inward slightly, as shown in FIG. 6, for the accommodation of like downwardly depending flanges 47 formed laterally of the side sections 41, 41', By this arrangement, it will be appreciated that movement of the stringer structures 9 toward or away from one another will cause sliding of the tread side sections 41, 41' within the sliding arrangement formed by the flanges 45, 47.

FIGS. 4 and 5 also show a structure to ensure that the tread side sections 41, 41' move an equal distance from the centre of the tread 25 even if only one of the stringer structures 9 is moved.

This structure is formed of a pair of guide links 49 located beneath the central and side tread sections 41, 41', being pivotally connected at their centres and also pivotally connected to the central tread section 43 by means of any pivot device 51 (FIG. 3). Appropriately inclined pairs of roller tracks 53 are provided beneath the tread side sections 41, 41' and into which tracks 53 are received rollers 55 provided at the free ends of the guide links 49 and rollably received within the tracks 53. It will thus be understood that this link structure ensures equal length displacement of the tread side section 41, 41', in relation to the treads 25 regardless of whether only one or the two of the stringer structures are displaced.

I claim:

1. An adjustable staircase comprising:

an upper connector and a lower conector;

a pair of stair stringer structures, each structure comprising:

two pantographs of equal length extending lengthwise between said connectors and one above the other, in the same plane of operation, each pantograph having opposed ends and being formed of successive pairs of diagonal levers of equal length pivoted at center points and at end points thereof;

means mounting said opposed ends of said pantographs, respectively on said connectors, for pivotal movement about parallel axes lying in an upper and in a lower horizontal plane, whereby corresponding pivot points on said two pantographs move together in parallel horizontal pivot points planes as said connectors are moved with respect to one another;

a plurality of treads between said stair stringer structures;

a plurality of like tread supports equal in number to that of said treads, each tread support comprising:

a pantograph portion pivotally connected to two of said corresponding pivot points lying in one of said pivot points horizontal planes;

a tread portion, and means fixing said tread portions of said tread supports to the end edges of said treads so as to hold said treads parallel to said pivot points horizontal planes, wherein each of said tread supports further comprises a generally U-shaped portion rapidly joining said pantograph portion and said tread portion.

2. An adjustable staircase as claimed in claim 1, wherein said pantograph portions and said tread portions lie on opposite sides of said pantographs.

3. An adjustable staircase as claimed in claim 2, wherein said opposed ends of each pantograph are formed of a pair of half-length levers connected at the free ends thereof.

4. An adjustable staircase as claimed in claim 1, further comprising open-ended casings, each enclosing one of said stringer structures; said connectors projecting out of the open ends of said casings and said casings being further formed with aperture means for the passage of said U-shaped portion of said tread supports.

5. An adjustable staircase comprising:

an upper connector and a lower connector;

a pair of stair stringer structures, each structure comprising:

two pantographs of equal length extending lengthwise between said connectors and one above the other, in the same plane of operation, each pantograph having opposed ends and being formed of successive pairs of diagonal levers of equal length pivoted at center points and at end points thereof;

means mounting said opposed ends of said pantographs, respectively on said connectors, for pivotal movement about parallel axes lying in an upper and in a lower horizontal plane, whereby corresponding pivot points on said two pantographs move together in parallel horizontal pivot points planes as said connectors are moved with respect to one another;

a plurality of treads between said stair stringer structures;

a plurality of like tread supports equal in number to that of said treads, each tread support comprising:

a pantograph portion pivotally connected to two of said corresponding pivot points lying in one of said pivot points horizontal planes;

a tread portion, and means fixing said tread portions of said tread supports to the end edges of said treads so as to hold said treads parallel to said pivot points horizontal planes, wherein each tread further comprises: two coplanar side sections extending horizontally from end edges of said tread and means joining said side sections together at the center for relative slidable displacement therebetween, lengthwise of said tread, when said stringer structures are moved to and from an other.

6. An adjustable staircase as claimed in claim 5, wherein said coplanar side section joining means comprise, for each tread, a central flat horizontal tread section overlapping said side sections;

slide means formed on opposed edges of said central sections and corresponding opposed edges of said side sections to allow relative displacement therebetween;

for each tread, a pair of guided links beneath said central and side tread sections;

means pivotally connecting said links at the centers thereof and to said tread central sections, and roller track means beneath said tread side sections and at the free ends of said links for ensuring equal length displacement of said tread side sections relative to said tread central sections when said stringer structures are moved relative to one another.

* * * * *